US006854431B2

(12) United States Patent
Gaessler et al.

(10) Patent No.: US 6,854,431 B2
(45) Date of Patent: Feb. 15, 2005

(54) INTERNAL COMBUSTION ENGINE COMPRISING A HYDRAULIC SYSTEM

(75) Inventors: Hermann Gaessler, Vaihingen (DE); Udo Diehl, Stuttgart (DE); Karsten Mischker, Leonberg (DE); Rainer Walter, Pleidelsheim (DE); Bernd Rosenau, Tamm (DE); Stefan Franzl, Drancy (FR); Juergen Schiemann, Markgroeningen (DE); Christian Grosse, Kornwestheim (DE); Volker Beuche, Stuttgart (DE); Stefan Reimer, Markgroeningen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/297,426

(22) PCT Filed: Feb. 19, 2002

(86) PCT No.: PCT/DE02/00586

§ 371 (c)(1),
(2), (4) Date: May 19, 2003

(87) PCT Pub. No.: WO02/081875

PCT Pub. Date: Oct. 17, 2002

(65) Prior Publication Data

US 2003/0188702 A1 Oct. 9, 2003

(30) Foreign Application Priority Data

Apr. 6, 2001 (DE) ..... 101 17 094

(51) Int. Cl.[7] ..... F01L 9/02

(52) U.S. Cl. ..... 123/90.12; 123/90.13; 123/90.15; 123/90.33; 123/196 R; 123/446; 184/6.5

(58) Field of Search ..... 184/6.5, 6.9; 123/90.12, 123/90.13, 90.33, 196 R, 196 C, 90.15, 90.16, 90.17, 446; 417/228, 364

(56) References Cited

U.S. PATENT DOCUMENTS

| | | | | |
|---|---|---|---|---|
| 5,186,129 A | * | 2/1993 | Magnan et al. | 123/90.34 |
| 5,697,336 A | * | 12/1997 | Eisenbacher et al. | 123/324 |
| 5,878,710 A | * | 3/1999 | Ritter et al. | 123/198 DB |
| 5,894,830 A | | 4/1999 | Blass | |
| 5,915,348 A | | 6/1999 | Scheidt | |
| 6,148,805 A | | 11/2000 | Bartley | |
| 6,261,069 B1 | * | 7/2001 | Djordjevic | 417/313 |
| 6,318,974 B1 | * | 11/2001 | Itoh et al. | 417/315 |

FOREIGN PATENT DOCUMENTS

| | | |
|---|---|---|
| DE | 31 37 600 C1 | 4/1983 |
| DE | 40 33 105 A1 | 4/1992 |
| DE | 42 17 910 A1 | 12/1993 |
| DE | 198 27 932 A1 | 1/1999 |
| EP | 0 503 635 A1 | 9/1992 |

* cited by examiner

*Primary Examiner*—Thomas Denion
*Assistant Examiner*—Jaime W Corrigan
(74) *Attorney, Agent, or Firm*—Ronald E. Greigg

(57) ABSTRACT

An internal combustion engine includes a hydraulic system with a hydraulic pump. A lubricant system for moving parts of the engine is also provided, which includes a lubricant pump. To enable making the engine smaller, it is proposed that the hydraulic pump is connected to the lubricant system in such a way that it can be lubricated by the lubricant.

6 Claims, 2 Drawing Sheets

INTERNAL COMBUSTION ENGINE COMPRISING A HYDRAULIC SYSTEM

CROSS-REFERENCE TO RELATED APPLICATIONS

This application is a 35 USC 371 application of PCT/DE 02/00586 filed on Feb. 19, 2002.

BACKGROUND OF THE INVENTION

1. Field of the Invention

The invention relates to an internal combustion engine, having a hydraulic system which includes a hydraulic pump, and having a lubricant system, for moving parts of the engine, which includes a lubricant pump.

2. Description of the Prior Art

One engine of the type with which this invention is concerned is known on the market. For its moving parts, such as pistons, crankshaft, and so forth, a forced-circulation lubrication is provided, which is supplied from an oil sump via an oil pump. At the same time, in the known engine, a hydraulic system is provided which is used to actuate the inlet and outlet valves of the engine. The known engine accordingly has no camshaft. Such an engine has the advantage that the control times for the inlet and outlet valves are independent of the position of the piston of the applicable cylinder. Depending on the operating state of the engine, such as high rpm, and on the torque desired by the driver, valve opening and closing times can be achieved that enable operation of the engine especially optimally in terms of emissions and fuel consumption.

The hydraulic system of the known internal combustion engine is supplied from a hydraulic reservoir via a high-pressure hydraulic pump. A hydraulic cylinder supplied from the hydraulic system is connected to the tappet of a gas exchange valve, such as an inlet or outlet valve, and leads to an opening or closing motion of this valve.

The object of the present invention is to refine an internal combustion engine of the type defined at the outset in such a way that it is as small as possible in structure and can be produced as inexpensively as possible.

In an internal combustion engine of the type defined at the outset, this object is attained in that the hydraulic pump is connected to the lubricant system in such a way that it is lubricated by the lubricant of the lubricant system.

SUMMARY OF THE INVENTION

The hydraulic pump is in general a heavy-duty high-pressure pump that furnishes the requisite pressure for safe operation of the hydraulic system. To enable this hydraulic pump to produce the required power reliably under all operating states of the engine, complete and certain lubrication of all the moving parts of the hydraulic pump is necessary. Because according to the invention the lubrication of the moving parts of the hydraulic pump is accomplished by the lubricant of the engine lubricant system that is present anyway, it is possible to dispense with a separate lubricant system for only the hydraulic pump. Thus the components required for such a lubricant system, such as a special lubricant pump, a lubricant container, and so forth, can be dispensed with. In this way, the engine according to the invention can be made smaller. Moreover, with the omission of the aforementioned components, expenses are saved.

Advantageous refinements of the invention are disclosed. In a first such refinement, it is stated that as hydraulic fluid, the lubricant of the lubricant system is used. In that case, it is accordingly possible to dispense with a separate container for the hydraulic fluid. This further reduces the size of the engine of the invention. Because the hydraulic fluid and the lubricant are identical, it is furthermore possible to use similar or even identical parts in both systems, which further reduces both production and maintenance costs.

It is especially preferred if the hydraulic pump is connected to the lubricant system in such a way that the pump is fed from the system, and so the lubricant pump operates as a prefeed pump for the hydraulic system. This refinement of the engine of the invention is preferred especially whenever the hydraulic pump is not a self-aspirating pump. In all other cases as well, however, this refinement of the engine of the invention also has the advantage that the hydraulic pump can be smaller, because since the lubricant pump furnishes a prefeed pressure, the hydraulic pump has to have only a comparatively lesser capacity.

Alternatively, however, it can be provided that the hydraulic pump pumps a hydraulic medium that differs from the lubricant of the lubricant system of the engine, preferably a lower viscosity. Especially at low temperatures, it can happen that the viscosity of the fluid typically used as a lubricant in internal combustion engines becomes so great that both the pumping of the hydraulic fluid by the hydraulic pump and its transport into the hydraulic lines are impaired. If an internal combustion engine is used under environmental conditions of this kind, it can be advantageous if a fluid which even at very low temperatures has an extremely low viscosity can be used as the hydraulic fluid. On the other hand, such a fluid would be poorly suited as a lubricant for the lubricant system of the engine, since at the high temperatures typically prevailing in the engine, it could no longer adequately assure proper lubrication of the moving parts of the engine.

It is also possible that a filter, in particular a fluid filter of the lubricant system, is disposed in the fluid path between the lubricant system and the hydraulic pump. With a fluid filter of this kind, the risk that the hydraulic system will become plugged with deposits that accumulate in the lubricant over time can be reduced. In this way, the operating safety of the engine of the invention is thus enhanced. If the fluid filter of the lubricant system, for instance a classical oil filter, is used, then this can be done without additional components and thus also without additional cost. However, it is also conceivable, besides the fluid filter of the lubricant system, to use still another filter, in order to assure the purity of the lubricant furnished to the hydraulic system.

In another refinement, it is stated that the hydraulic system includes a power unit, which is connected to a gas exchange valve of the engine in such a way that this valve can be opened and/or closed by the power unit. Such a power unit can for instance be a hydraulic cylinder, whose piston is connected to the valve shaft of the gas exchange valve, which for instance is an inlet or outlet valve of the engine.

With the goal of further reducing the installation space required for installing the engine of the invention, for instance in a motor vehicle, it is also proposed that the hydraulic pump is driven by the engine. In this case, a separate drive mechanism, such as an electric, motor, can thus be omitted.

The drive of the hydraulic pump by the engine can be done especially effectively whenever the hydraulic pump is connected directly to a crankshaft of the engine.

However, it is also possible that the hydraulic pump is connected to driven moving parts of the engine via a gear mechanism with a variable gear ratio. In that case, it is possible for the capacity of the hydraulic pump to be adapted to the current operating state of the engine. This lengthens the service life of the engine of the invention, or its hydraulic pump, since it does not always operate at maximum capacity but instead, when less capacity is demanded, is also driven at lesser capacity.

BRIEF DESCRIPTION OF THE DRAWINGS

Below, two exemplary embodiments of the invention are described in detail in conjunction with the accompanying drawing. Shown in the drawing are.

DESCRIPTION OF THE PREFERRED EMBODIMENTS

Figure 1:
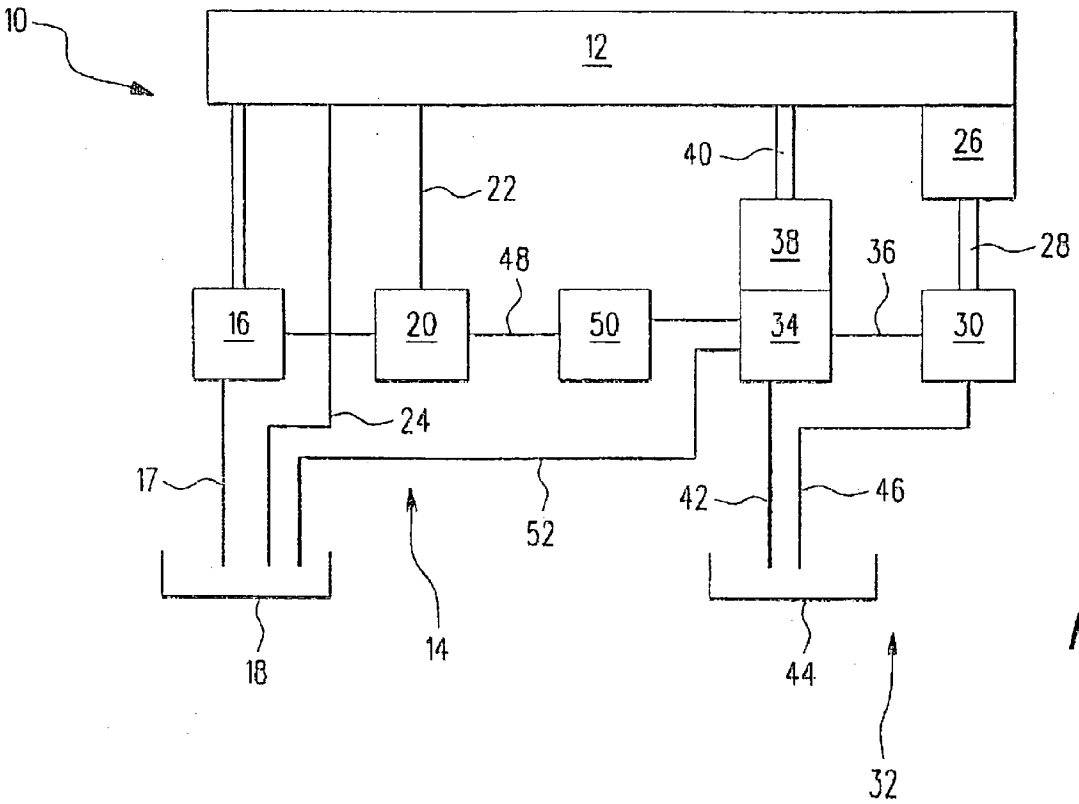
FIG. 1: a schematic block circuit diagram of a first exemplary embodiment of an internal combustion engine.

An internal combustion engine is identified overall by reference numeral 10 in FIG. 1. A central region 12 of the engine 10 includes, among other elements, an engine block, combustion chambers, pistons, and so forth. The moving parts of the engine 10, such as pistons, crankshaft, and so forth, are supplied with lubricant by a lubricant system 14.

The lubricant system 14 includes a lubricant pump 16, which pumps lubricant from a lubricant sump 18 via an intake conduit 17. The lubricant pump in the present exemplary embodiment is a typical geared pump. As the lubricant for the moving parts of the engine 10, in the exemplary embodiment shown in FIG. 1, a synthetic lightweight oil is used.

Via a lubricant filter 20, the lubricant is pumped through a lubricant conduit 22 to the moving parts in the central region 12 of the engine 10. Via a return line 24, the lubricant flows back out of the engine block 12 into the lubricant sump 18. The drive of the lubricant pump 16 is effected via a mechanical connection, represented only symbolically in the drawing, with driven moving parts of the engine 10. A drive via a toothed belt is also possible, for instance.

An inlet valve 26, shown by way of example and only symbolically, serves to supply the combustion chamber (not shown), located in the central region 12 of the engine 10, with a fuel-air mixture. The inlet valve 26 communicates with the piston (not shown) of a hydraulic cylinder 30 via a mechanical connection 28. The hydraulic cylinder 30 is in turn part of a hydraulic system 32, which also includes a hydraulic pump 34 that supplies the hydraulic cylinder 30 with hydraulic fluid via a hydraulic line 36.

The hydraulic pump 34 is driven via a controllable gear mechanism 38 by a crankshaft 40, represented only symbolically in FIG. 1, of the engine 10. However, it is also conceivable for it to be integrated into the wheel drive of the engine 10. Preferably, the hydraulic pump 34 is mounted at the front or laterally on the engine block (central region 12) of the engine 10. The hydraulic pump 34 is a high-pressure piston pump. The hydraulic pump 34 pumps hydraulic fluid from a hydraulic container 44 via an intake line 42. The hydraulic fluid supplied to the hydraulic cylinder 30 flows back to the hydraulic container 44 again via a return line 46.

Because of the high pressure required in the hydraulic system 32, the hydraulic pump 34 is a heavy-duty pump, whose moving parts must be adequately lubricated if the required power and service life are to be achieved reliably. The hydraulic pump 34 therefore has its own lubrication system, not identified by reference numeral in FIG. 1. The supply of lubricant to the lubrication system of the hydraulic pump 34 is effected from the lubricant filter 20 of the lubricant system 14 via a branch line 48 and a supplementary filter 50. However, filtration independently of the lubricant system 14, by means of a separate fine filter (not shown) of the lubricant delivered to the hydraulic system 32 is also possible. For the lubrication of the moving parts of the hydraulic pump 34, the lubricant of the lubricant system 14 is accordingly used. The return of the lubricant is effective from the hydraulic pump 34 directly to the lubricant tub 18 via a return line 52.

The hydraulic fluid used in the engine 10 shown in FIG. 1 has a lower viscosity than the lubricant used in this engine 10. Thus even at low temperatures, it is assured that the pumping capacity of the hydraulic pump 34 to the hydraulic cylinder 30 is sufficient to enable secure actuation of the inlet valve 26. At the same time, because of the synthetic lightweight oil used, the lubrication of the moving parts in the engine 10, on the one hand, and in the hydraulic pump 34 on the other is assured.

The second exemplary embodiment of an engine 10, shown in FIG. 2, will now be described. Parts that have equivalent functions to corresponding parts in FIG. 1 are identified by the same reference numerals and are not explained in detail again.

Figure 2:
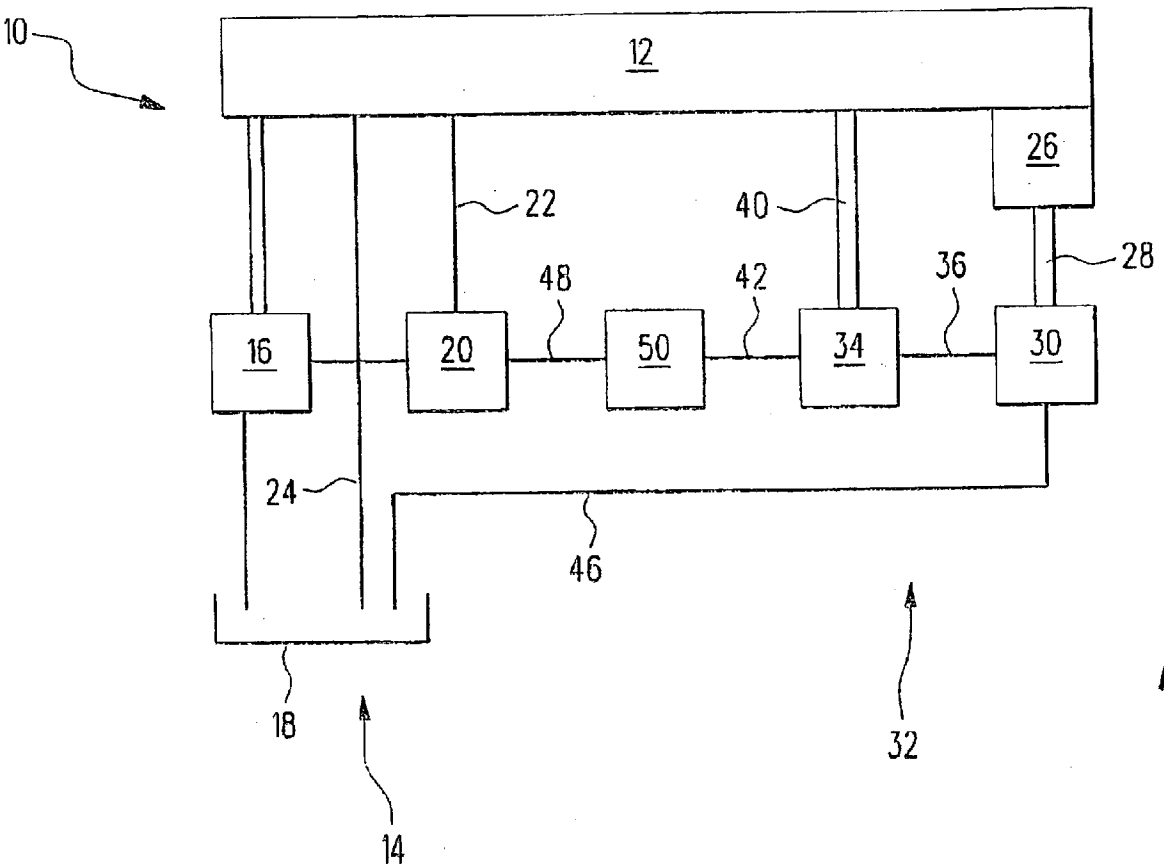
FIG. 2: a block circuit diagram, similar to FIG. 1, of a second exemplary embodiment of an internal combustion engine.

Unlike the exemplary embodiment in FIG. 1, in the engine 10 shown in FIG. 2 the lubricant of the lubricant system 14 is used as the hydraulic fluid. The lubricant pump 16 thus acts as a prefeed pump, which via the lubricant filter 20 and the supplementary filter 50 of the hydraulic pump 34 furnishes a pilot pressure. There is no provision for a separate lubrication system in the hydraulic pump 34. Instead, the moving parts in the hydraulic pump 34 are lubricated by the lubricant that they pump.

In the engine 10 shown in FIG. 2, a separate container for the hydraulic fluid is thus omitted. The lubricant or hydraulic fluid is returned from the hydraulic cylinder 30 directly to the lubricant sump 18 via the return line 46. Thus the lubricant sump 18 also acts as the supply reservoir for the hydraulic system 32. The engine 10 shown in FIG. 2 is therefore even smaller than the engine 10 shown in FIG. 1. Furthermore, fewer parts are needed in it, so that it can also be produced and operated less expensively. Moreover, the lubricant or hydraulic fluid is cooled by a lubricant cooling (not shown) that is usually present anyway, which further improves its service life. In addition, in the exemplary embodiment shown in FIG. 2, the hydraulic pump 34 is driven directly by the crankshaft 40 of the engine 10. In other words, power regulation via a gear mechanism is thus dispensed with.

The foregoing relates to preferred exemplary embodiment in this invention, it being understood that other variants and embodiments thereof are possible within the spirit and scope of the invention, the latter being defined by the appended claims.

What is claimed is:

1. An internal combustion engine (10), comprising a hydraulic system (32) that includes a hydraulic pump (34), and a lubricant system (14), for lubricating moving parts of the engine (10) including a lubricant pump (16), the hydraulic pump (34) being connected to the lubricant system (14) in such a way that lubricant is pumped from the lubricant pump (16) through a line (48) to the hydraulic pump (34) for lubricating the hydraulic pump (34), wherein the hydraulic pump (34) pumps a hydraulic fluid that differs from the lubricant of the lubricant system (14) of the engine (10), wherein the hydraulic fluid has a lower viscosity.

2. The engine (10) of claim 1, further comprising a filter (20, 50), is disposed in the line (48) between the lubricant system (14) and the hydraulic pump (34).

3. The engine (10) of claim 1, wherein the hydraulic system (32) comprises a power unit (30) connected to a gas exchange valve (26) of the engine (10) in such a way that this valve can be at least one of opened and closed by the power unit (30).

4. The engine (10) of claim 1, wherein the hydraulic pump (34) is driven by the engine (10).

5. The engine (10) of claim 4, wherein the hydraulic pump (34) is connected directly to a crankshaft (40) of the engine (10).

6. The engine (10) of claim 4, wherein the hydraulic pump (34) is connected to moving parts (40) of the engine (10) via a gear mechanism (38) with a variable gear ratio.

* * * * *

UNITED STATES PATENT AND TRADEMARK OFFICE

CERTIFICATE OF CORRECTION

PATENT NO. : 6,854,431 B2 
DATED : February 16, 2005
INVENTOR(S) : Hermann Gaessler et al.

It is certified that error appears in the above-identified patent and that said Letters Patent is hereby corrected as shown below:

Title page,
Item [54], Title, please correct to read:
-- INTERNAL COMBUSTION ENGINE WITH A HYDRAULIC SYSTEM --

Signed and Sealed this

Twenty-sixth Day of April, 2005

JON W. DUDAS
*Director of the United States Patent and Trademark Office*